US005472001A

United States Patent [19]

Nicholson

[11] Patent Number: 5,472,001

[45] Date of Patent: Dec. 5, 1995

[54] SMOKELESS CIGARETTE FILTER DEVICE

[76] Inventor: Darrin J. Nicholson, 1099 Ala Napunani St., Apt. 602, Honolulu, Hi. 96818

[21] Appl. No.: 220,228

[22] Filed: Mar. 30, 1994

[51] Int. Cl.[6] ..... A24F 13/02; A24F 13/08

[52] U.S. Cl. ..... 131/187; 131/198.1; 131/185; 131/234

[58] Field of Search ..... 131/330, 175, 131/187, 185, 189, 190, 198.1, 202, 234, 237

[56] References Cited

U.S. PATENT DOCUMENTS

| | | | |
|---|---|---|---|
| 2,108,218 | 2/1938 | Stultz . | |
| 2,173,211 | 9/1939 | Lykos et al. | 131/175 |
| 2,541,837 | 2/1951 | Schroff | 131/175 |
| 2,620,804 | 12/1952 | McMahon . | |
| 4,148,328 | 4/1979 | Fox . | |
| 4,200,114 | 4/1980 | Waite . | |
| 4,637,407 | 1/1987 | Bonanno et al. | 131/175 |
| 4,774,970 | 10/1988 | Bell | 131/185 X |
| 4,790,332 | 12/1988 | Wallace . | |
| 5,048,545 | 9/1991 | Takagi et al. | 131/330 |
| 5,353,814 | 10/1994 | Martin | 131/175 X |
| 5,396,907 | 3/1995 | Henao et al. | 131/175 |

*Primary Examiner*—Jennifer Bahr
*Attorney, Agent, or Firm*—Michael I. Kroll

[57] ABSTRACT

A smokeless cigarette filter device has a barrel fabricated out of molded, heat resistant durable material. A structure on a first end of the barrel is for covering the mouth and nose of a smoker. An element is provided for holding a cigarette within the barrel, so that a butt end of the cigarette can enter the mouth and nose covering structure. A component is provided for lighting a distal end of the cigarette within the barrel when the smoker inhales. An assembly is on a second end of the barrel, for filtering harmful first and second hand smoke coming from the lit cigarette and the smoker, so as to prevent the smoke from ever reaching the outside air. An apparatus is provided for extinguishing the cigarette within the barrel, when the smoker is done smoking the cigarette.

13 Claims, 2 Drawing Sheets

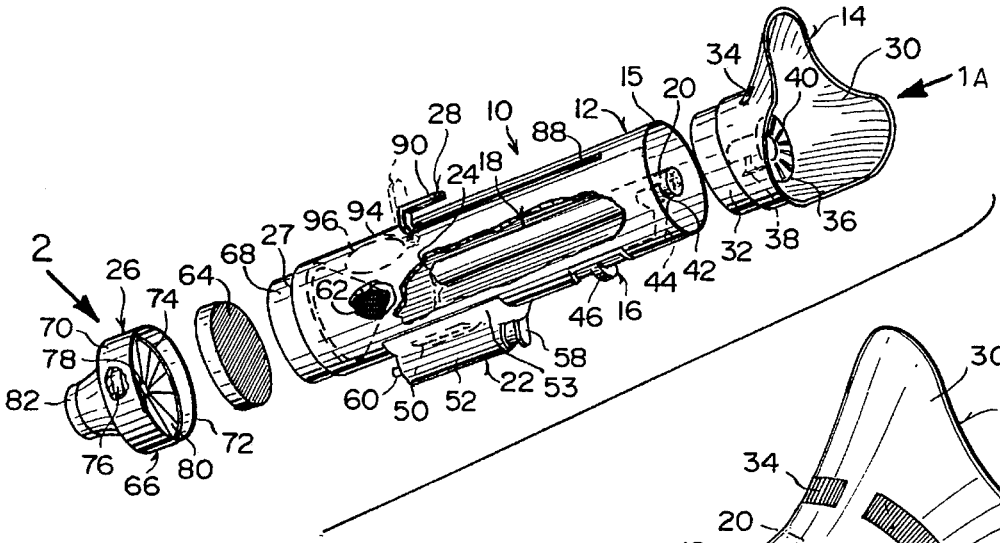
Fig. 1
Fig. 1A
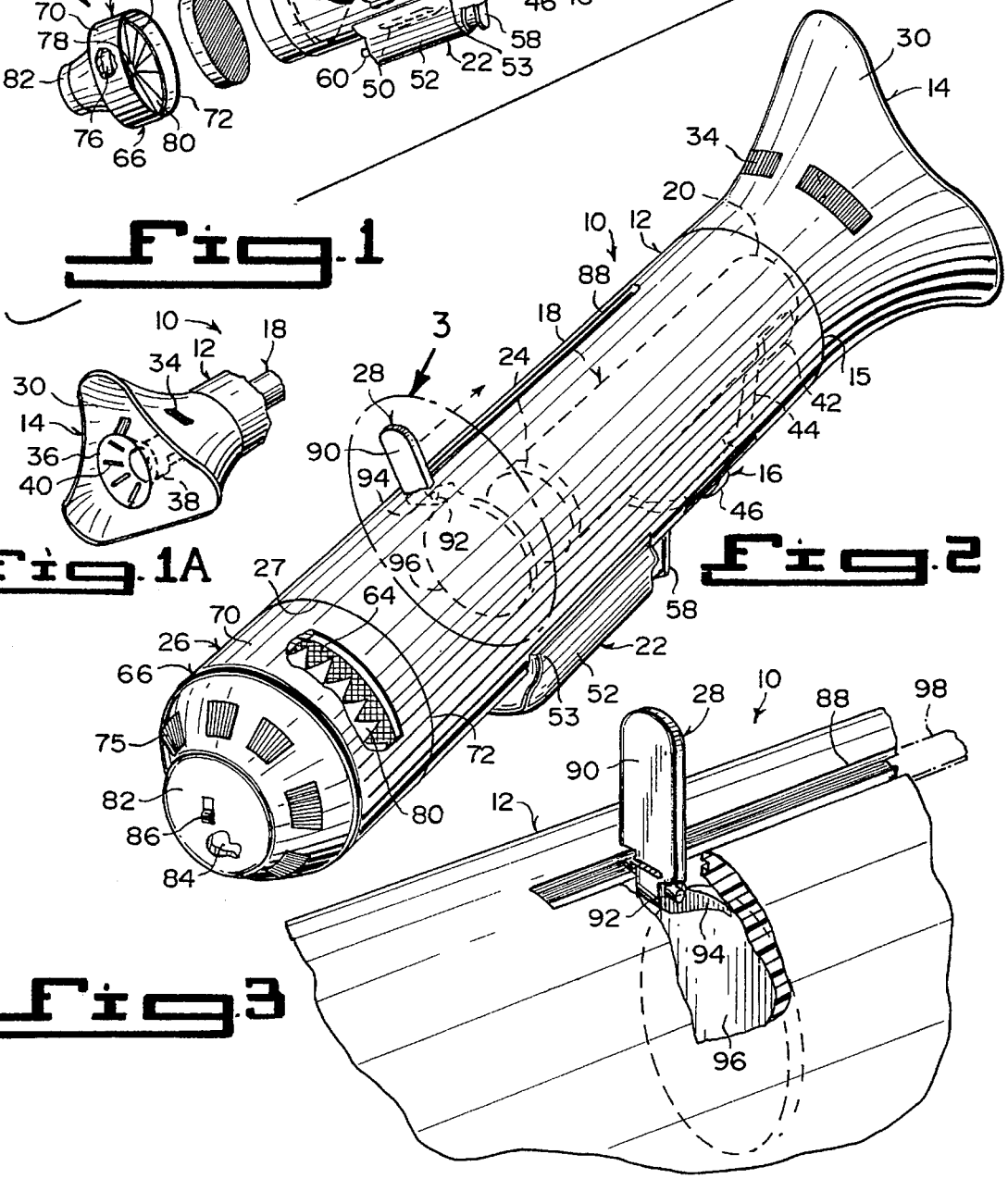
Fig. 2
Fig. 3

SMOKELESS CIGARETTE FILTER DEVICE

BACKGROUND OF THE INVENTION

1. Field of the Invention

The instant invention relates generally to smoking devices and more specifically it relates to a smokeless cigarette filter device.

2. Description of the Prior Art

Numerous smoking devices have been provided in prior art. For example, U.S. Pat. Nos. 2,108,218 to Stultz; 2,620,804 to McMahon; 4,148,328 to Fox and 4,790,332 to Wallace all are illustrative of such prior art. While these units may be suitable for the particular purpose to which they address, they would not be as suitable for the purposes of the present invention as heretofore described.

STULTZ, HARVEY C.

SMOKING DEVICE

U.S. Pat. No. 2,108,218

A smoking device comprising a rectangular metallic casing that includes a bottom, end walls and side walls. The top of the casing is open and the side walls have perforations therein in substantially the upper halves of the walls. A neck projects inwardly from one of the end walls. The neck projects into the perforated part of the casing. The end wall has an opening in its lower half. A drawer passes through the opening into the unperforated part of the casing. A holder for cigarettes and cigars has a reduced part passing through the neck and a head located in the perforated part of the casing. A tube is connected with the projecting portion of the reduced part. A mouthpiece is on the free end of the tube. A substantially anticlinal perforated cover fits over the upper open end of the casing. The internal walls of the casing and cover are plain and unobstructed with the exception of the neck.

MC MAHON, HOWARD J.

BLACKOUT CIGARETTE SMOKER

U.S. Pat. No. 2,620,804

A light-tight cigarette holder comprising a mouthpiece adapted to receive a cigarette. An elongated hollow body member has one end secured to the mouthpiece and is arranged to enclose a cigarette held in the mouthpiece. A housing has one end open and has an end wall substantially closing the other end thereof arranged so that the open end is secured to the other end of the body. The end wall of the housing is formed with an air intake opening. A baffle member is mounted in the housing adjacent the opening and in light shielding relation thereof relative to the remainder of the interior of the housing. A match striking surface is carried by the baffle member. The housing is formed with an opening adjacent the match-striking surface for the admission of a match.

FOX, ALVIN F.

SAFETY SMOKER

U.S. Pat. No. 4,148,328

A base member has a recess in its top surface, and the bottom wall of the recess has a vertical socket arranged to hold a cigarette upright. A flexible tube is connected into the base member for communication with the socket and has a smoking tip whereby a cigarette in the base member can be smoked by a person remote from the cigarette. A hollow lid is employed which can be locked in place on the base member to prevent access to the cigarette being smoked. The lid has apertures placed at selected upper and lower portions therein to provide a draft ventilation for cigarette smoke.

WALLACE, FRED E.

SMOKE ELIMINATOR FOR CIGARETTE SMOKERS

U.S. Pat. No. 4,790,332

A hand-held device eliminates smoke generated from cigarette smoking. This cigarette package-sized device completely encloses a cigarette while it is being smoked and provides two mouthpieces, one for inhaling and the other for exhaling smoke into the device. All smoke passes through two filters, a particulate filter and an odor filter, before being discharged into the ambient atmosphere.

SUMMARY OF THE INVENTION

A primary object of the present invention is to provide a smokeless cigarette filter device that will overcome the shortcomings of the prior art devices.

Another object is to provide a smokeless cigarette filter device that will allow cigarette smokers to light up whenever and wherever they desire without the worries of harming the health of others or contributing to air pollution.

An additional object is to provide a smokeless cigarette filter device that totally encapsulates the cigarette and filters harmful first and second hand smoke to prevent the smoke from ever reaching the outside air, since the cigarette is lit, smoked and extinguished within the device.

A further object is to provide a smokeless cigarette filter device that is simple and easy to use.

A still further object is to provide a smokeless cigarette filter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a partially exploded front perspective view of a first embodiment of the instant invention with parts broken away to show the ash screen and cigarette therein.

FIG. 1A is a front perspective view taken in the direction of arrow 1A in FIG. 1, with the barrel broken away.

FIG. 2 is an assembled rear perspective view taken in the direction of arrow 2 in FIG. 1, with parts broken away to show the fan blades and filter disk therein.

FIG. 3 is an enlarged front perspective view of an area as indicated by arrow 3 in FIG. 2, with the barrel broken away to show parts of the cigarette extinguisher assembly in greater detail.

DETAILED DESCRIPTION OF THE PREFERRED EMBODIMENTS

Figure 4:
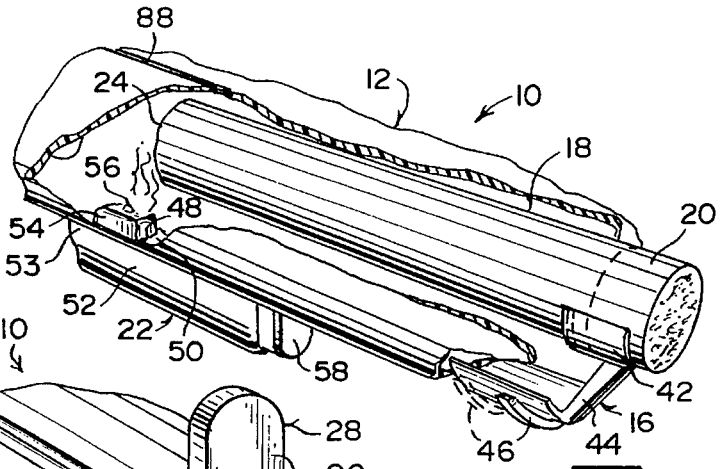
FIG. 4 is a front perspective view of a portion of the barrel broken away, showing the cigarette holder and lighter in greater detail.
Figure 5:
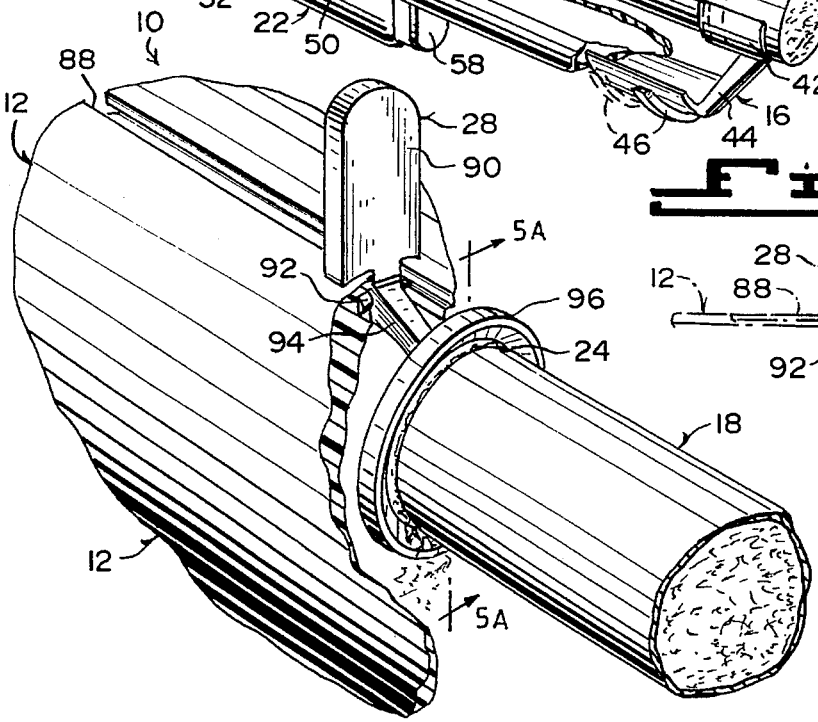
FIG. 5 is an enlarged front perspective view of a portion of the barrel broken away, showing the cigarette extinguisher assembly in greater detail.
Figure 5A:
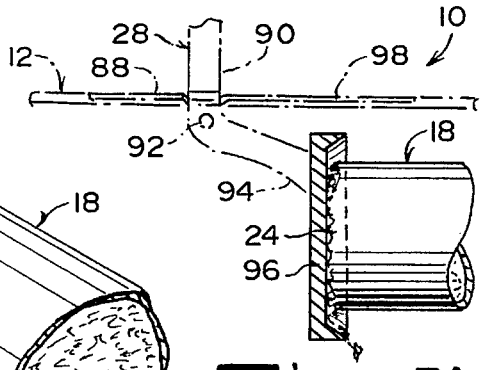
FIG. 5A is a cross sectional view with parts in phantom taken along line 5A—5A in FIG. 5.

Turning now descriptively to the drawings, in which similar reference characters denote similar elements throughout the several views, FIGS. 1 through 6 illustrate a smokeless cigarette filter device 10, which consists of a barrel 12 fabricated out of molded, heat resistant durable material. A structure 14 on a first end 15 of the barrel 12 is for covering the mouth and nose of a smoker. An element 16 is for holding a cigarette 18 within the barrel 12, so that a butt end 20 of the cigarette can enter the mouth and nose covering structure 14. A component 22 is for lighting a distal end 24 of the cigarette 18 within the barrel 12 when the smoker inhales. An assembly 26 is on a second end 27 of the barrel 12, for filtering harmful first and second hand smoke coming from the lit cigarette 18 and the smoker, so as to prevent the smoke from ever reaching the outside air. An apparatus 28 is for extinguishing the cigarette 18 within the barrel 12, when the smoker is done smoking the cigarette 18.

The mouth and nose covering structure 14 is a mouth and nose cup mask 30, molded of pliable material that will snugly conform to the face of the smoker. The mouth and nose cup mask 30 includes a collar 32 that is removable from the first end 15 of the barrel 12 for cigarette 18 placement and cleaning.

The mouth and nose cup mask 30 further contains a plurality of one way inlet valves 34, to allow air to enter, prevent the escape of smoke filled air while the smoker is smoking and prevent the mouth and nose cup mask 30 from collapsing when it is pressed against the smoker's face. The mouth and nose cup mask 30 further includes a cigarette guide and exhalation vent 36, being funnel shaped and having a centered cigarette guide sleeve 38 to receive the butt end 20 of the cigarette 18 surrounded by a plurality of vent holes 40. The vent holes 40 are for allowing exhaled smoke from the mouth of the smoker after it is drawn directly from the butt end 20 of the cigarette 18, to be blown back into the device 10. The vent holes 40 are also for allowing air to freely enter the device 10, while the mouth and nose cup mask 30 is not against the face of the smoker for the filtration of first hand smoke.

The cigarette holding element 16 contains a clamp 42, for engaging the butt end 20 of the cigarette 18. The clamp 42 is removable and interchangeable for cleaning purposes. The installation of a smaller clamp is to facilitate a smaller diameter cigarette 18. A stem 44 extends from the clamp 42. A spring loaded thumb lever 46 is connected to the stem 44, to thrust the butt end 20 of the cigarette 18 into the guide sleeve 38 and return to its original position when released.

The lighting component 22 consists of a slide member 50 formed on the barrel 12 that has an aperture 48 below the distal end 24 of the cigarette 18. A cigarette lighter 52 has a slide railing 53, to mate with the slide member 50. A spark ignitor 54 has a flame opening 56 in the cigarette lighter 52 that is positioned within the aperture 48 directly under the distal end 24 of the cigarette 18. A plunger 58 in the cigarette lighter 52 operates the spark ignitor 54. A butane refill nozzle 60 is for refueling the cigarette lighter 52.

The filtering assembly 26 includes an ash screen 62 insertable into the second end 27 of the barrel 12, for collecting ashes from the lit distal end 24 of the cigarette 18. A filter disc 64 is also insertable into the second end 27 of the barrel 12 behind the ash screen 62 and is capable of filtering the cigarette smoke from the air within the barrel 12. An exhaust assembly 66 is removable from a collar 68 at the second end 27 of the barrel 12, to replace the ash screen 62 and the filter disc 64 when needed. The exhaust assembly 66 will expel filtered air into the outside air.

Figure 6:
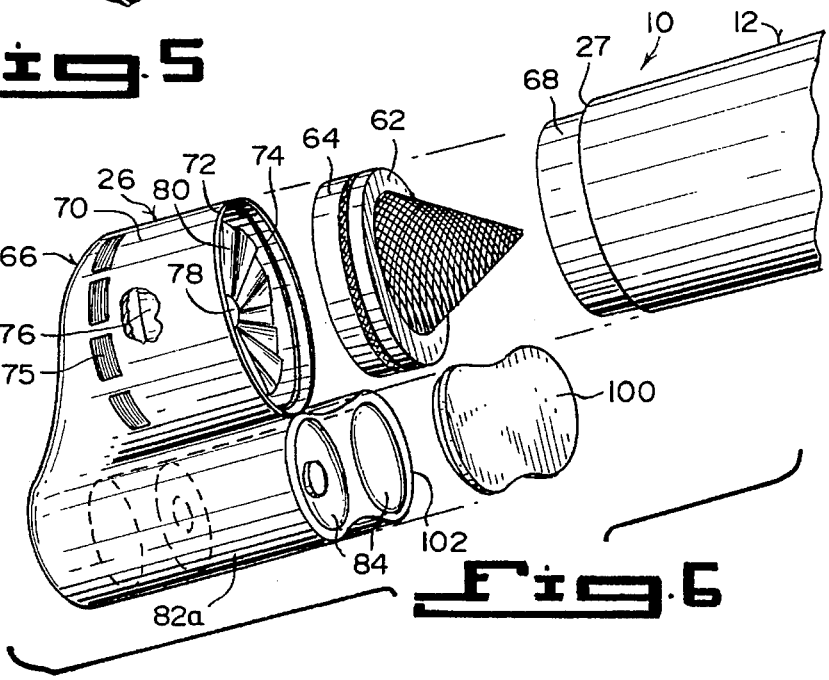
FIG. 6 is a partially exploded front perspective view of a rear portion of a second embodiment of the instant invention.

The ash screen 62, as shown in FIGS. 1 and 6, is conical shaped. The point is inserted facing the lit distal end 24 of the cigarette 18, which will direct the ashes toward a rim of the screen 62 to allow its middle portions to remain cleaner longer.

The exhaust assembly 66 contains a housing 70, having an open end 72 with an internal rim 74 to act as a stop for the filter disc 64. The filter disc 64 rests on the rim 74, when the open end 72 of the housing 70 fits over the collar 68 of the barrel 18. The housing 70 has a plurality of vent holes 75 located in a rear portion thereof, to allow the filtered air to be expelled therefrom. A motor 76 with a shaft 78 is mounted within the housing 70, so that the shaft 78 extends towards the open end 72 of the housing 70. A plurality of fan blades 80 are affixed onto the shaft 78 within the open end 72 of the housing 70, to be rotated by the shaft 78 for extracting the filtered air through the filter disc 64. A battery compartment 82 is located in the rear portion of the housing 70, for retaining at least one battery 84 therein for supplying power to the motor 76. A switch 86 is mounted on a distal end of the battery compartment 82, to turn the motor 76 on and off.

The extinguishing apparatus 28 consists of the barrel 12 having a top longitudinal slide track 88 above the entire length of the cigarette 18. A hinged lever 90 has two pivot pin followers 92, to ride in the slide track 88. The lever 90 extends above the slide track 88. An arm 94 extends from the lever 90 within the barrel 12. A beveled pan shaped fireproof disk 96 is connected to the arm 94. When the lever 90 is manually raised to a vertical position, the arm 94 will swing the fireproof disk 96 down into a vertical position to be perfectly aligned with the lit end 24 of the cigarette 18, for movement to and from the lit end 24 of the cigarette 18 to stamp it out. A ribbon seal 98 covers the slide track 88, to prevent the escape of cigarette smoke during the lighting process.

FIG. 6 shows a modified battery compartment **82*a* under the housing 70 instead of to the rear of it. A cover 100 fits over an open end 102 of the battery compartment 82*a*, to keep the batteries 84 therein. In this way, the motor 76 in the housing 70 and the battery compartment 82*a* can be made larger to function better in the device 10**.

LIST OF REFERENCE NUMBERS

10 smokeless cigarette filter device
12 barrel
14 mouth and nose covering structure
15 first end of 12
16 holding element
18 cigarette
20 butt end of 18
22 lighting component
24 distal end of 18
26 filtering assembly
27 second end of 12
28 extinguishing apparatus
30 mouth and nose cup mask for 14
32 collar on 30
34 one way inlet valve in 30
36 cigarette guide and exhalation vent in 30
38 guide sleeve of 36
40 vent hole in 36
42 clamp of 16
44 stem on 42
46 spring loaded thumb lever on 44
48 aperture in 12
50 slide member on 12 at 48
52 cigarette lighter
53 slide railing on 52
54 spark ignitor on 52
56 flame opening on 52
58 plunger on 52
60 butane refill nozzle on 52
62 ash screen
64 filter disc
66 exhaust assembly
68 collar at 27
70 housing
72 open end of 70
74 internal rim in 70
75 vent hole in 70
76 motor in 70
78 shaft on 76
80 fan blade
82 battery compartment
**82*a*** modified battery compartment
84 battery
86 switch
88 slide track in 12
90 hinged lever
92 pivot pin follower on 90
94 arm on 90
96 beveled pan shaped fireproof disk on 94
98 split ribbon seal
100 cover for **82*a***
102 open end of **82*a***

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A smokeless cigarette filter device which comprises:

a) a barrel fabricated out of molded, heat resistant durable material;

b) means on a first end of said barrel for covering the mouth and nose of a smoker;

c) means for holding a cigarette within said barrel, so that a butt end of the cigarette can enter said mouth and nose covering means;

d) means for lighting a distal end of the cigarette within said barrel when the smoker inhales;

e) means on a second end of said barrel for filtering harmful first and second hand smoke coming from the lit cigarette and the smoker, so as to prevent the smoke from ever reaching the outside air; and f) means for extinguishing the cigarette within said barrel, when the smoker is done smoking the cigarette.

2. A smokeless cigarette filter device as recited in claim 1, wherein said mouth and nose covering means is a mouth and nose cup mask, molded of pliable material that will snugly conform to the face of the smoker.

3. A smokeless cigarette filter device as recited in claim 2, wherein said mouth and nose cup mask includes a collar that is removable from the first end of said barrel for cigarette placement and cleaning.

4. A smokeless cigarette filter device as recited in claim 3, wherein said mouth and nose cup mask further includes a plurality of one way inlet valves to allow air to enter, prevent the escape of smoke filled air while the smoker is smoking and prevent said mouth and nose cup mask from collapsing, while it is pressed against the face of the smoker.

5. A smokeless cigarette filter device as recited in claim 4, wherein said mouth and nose cup mask further includes a cigarette guide and exhalation vent being funnel shaped and having a centered cigarette guide sleeve, to receive the butt end of the cigarette surrounded by a plurality of vent holes, whereby said vent holes are for allowing exhaled smoke from the mouth of the smoker, after it is drawn directly from the butt end of the cigarette, to be blown back into said device and said vent holes are also for allowing air to freely enter said device, while said mouth and nose cup mask is not against the face of the smoker for the filtration of first hand smoke.

6. A smokeless cigarette filter device as recited in claim 5, wherein said cigarette holding means includes:

a) a clamp for engaging the butt end of the cigarette, whereby said clamp is removable and interchangeable for cleaning purposes and the installation of a smaller clamp to facilitate a smaller diameter cigarette;

b) a stem extending from said clamp; and c) a spring loaded thumb lever connected to said stem to thrust the butt end of the cigarette into said guide sleeve and return to its original position when released.

7. A smokeless cigarette filter device as recited in claim 6, wherein said lighting means includes:

a) a slide member formed on said barrel and having an aperture below the distal end of the cigarette; and b) a removable cigarette lighter having a slide railing to mate with said slide member.

8. A smokeless cigarette filter device as recited in claim 7, wherein said cigarette lighter includes a spark ignitor having a flame opening that is positioned within said aperture directly under the distal end of the cigarette.

9. A smokeless cigarette filter device as recited in claim 8, wherein said cigarette lighter includes:

a) a plunger to operate said spark ignitor; and b) a butane refill nozzle for refueling said cigarette lighter.

10. A smokeless cigarette filter device as recited in claim 9, wherein said filtering means includes:

a) an ash screen insertable into the second end of said barrel for collecting ashes from the lit distal end of the cigarette;

b) a filter disc insertable into the second end of said barrel behind said ash screen capable of filtering the cigarette smoke from the air within said barrel; and c) an exhaust assembly that is removable from a collar at the second end of said barrel, to replace said ash screen and said filter disc when needed, whereby said exhaust assembly will expel filtered air into the outside air.

11. A smokeless cigarette filter device as recited in claim 10, wherein said ash screen is conical shaped with said point inserted facing the lit distal end of the cigarette, which will direct the ashes toward a rim of said screen to allow its middle portion to remain cleaner longer.

12. A smokeless cigarette filter device as recited in claim 11, wherein said exhaust assembly includes:

a) a housing having an open end with an internal rim to act as a stop for said filter disc, in which said filter disc rests on said rim when the open end of said housing fits over the collar of said barrel, said housing having a plurality of vent holes located in a rear portion thereof to allow the filtered air to be expelled therefrom;

b) a motor with a shaft mounted within said housing, so that said shaft extends towards the open end of said housing;

c) a plurality of fan blades affixed onto said shaft within the open end of said housing to be rotated by said shaft, for extracting the filtered air through said filter disc;

d) a battery compartment located in the rear portion of said housing for retaining at least one battery therein for supplying power to said motor; and e) a switch mounted on a distal end of said battery compartment to turn said motor on and off.

13. A smokeless cigarette filter device as recited in claim 12, wherein said extinguishing means includes:

a) said barrel having a top longitudinal slide track above the entire length of the cigarette;

b) a hinged lever having two pivot pin followers to ride in said slide track, said lever extending above said side track;

c) an arm extending from said lever within said barrel;

d) a beveled pan shaped fireproof disk connected to said arm, so that when said lever is manually raised to a vertical position, said arm will swing said fireproof disk down into a vertical position to be perfectly aligned with the lit end of the cigarette for movement to and from the lit end of the cigarette to stamp it out; and e) a ribbon seal to cover said slide track to prevent the escape of cigarette smoke during the lighting process.

* * * * *